US005887533A

United States Patent [19]

Tsukioka et al.

[11] Patent Number: 5,887,533

[45] Date of Patent: Mar. 30, 1999

[54] CHAIN-STITCH SEWING MACHINE WITH KNOT TYING

[75] Inventors: Takashi Tsukioka; Takayuki Shiina; Tadayoshi Minagawa; Yoh Oda, all of Tokyo, Japan

[73] Assignee: Juki Corporation, Tokyo, Japan

[21] Appl. No.: 907,489

[22] Filed: Aug. 8, 1997

Related U.S. Application Data

[62] Division of Ser. No. 728,123, Oct. 9, 1996.

[30] Foreign Application Priority Data

Oct. 9, 1995 [JP] Japan ..... 7-261883
Feb. 26, 1996 [JP] Japan ..... 8-38130

[51] Int. Cl.[6] ..... D05B 3/14; D05B 1/06; D05B 57/04

[52] U.S. Cl. ..... 112/65; 112/156; 112/197

[58] Field of Search ..... 112/197, 187, 112/65, 66, 156, 168, 475.25, 201, 254, 255

[56] References Cited

U.S. PATENT DOCUMENTS

| | | | |
|---|---|---|---|
| 857,941 | 6/1907 | Horton | 112/156 |
| 2,158,197 | 5/1939 | Pikul | 112/255 X |
| 2,696,794 | 12/1954 | Kirsch | 112/197 |
| 3,447,498 | 6/1969 | Eguchi | 112/197 |
| 3,720,178 | 3/1973 | Ivanko | 112/168 |
| 4,169,422 | 10/1979 | Hayes et al. | 112/201 X |

*Primary Examiner*—Ismael Izaguirre
*Attorney, Agent, or Firm*—Morgan, Lewis & Bockius LLP

[57] ABSTRACT

A method is disclosed where a knot is formed in chain-stitching, and a first loop formed by a stitch to an article to be sewn, two stitches ahead of a final stitch, is drawn through a second loop which is formed by a stitch one stitch ahead of the final stitch, whereby a knot where the first loop is fastened by the second loop is formed, such that a third loop is inserted through the second loop and is then cut.

3 Claims, 23 Drawing Sheets

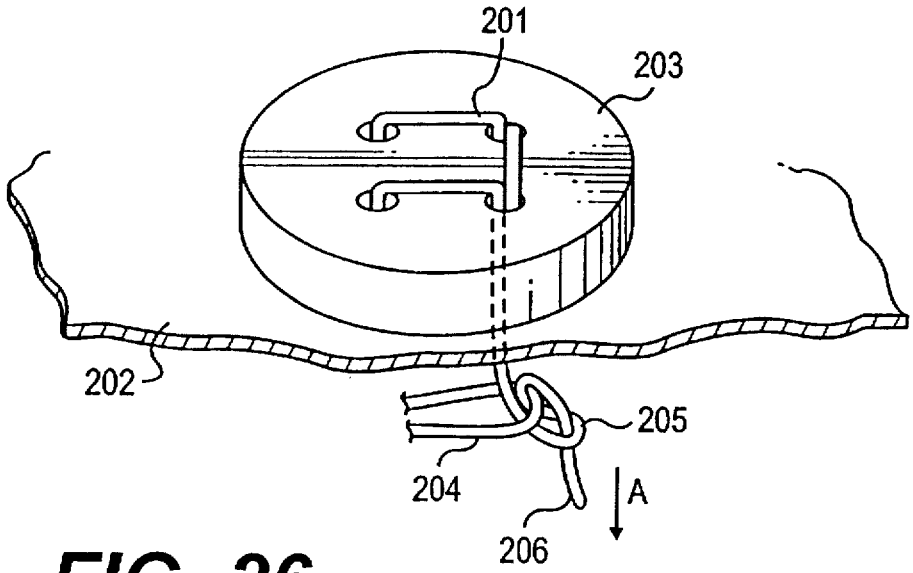
FIG. 26
PRIOR ART
FIG. 27
PRIOR ART
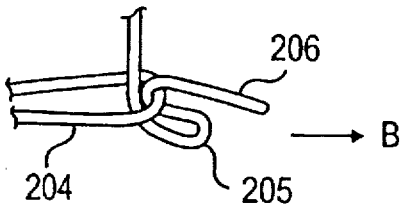
FIG. 28
PRIOR ART
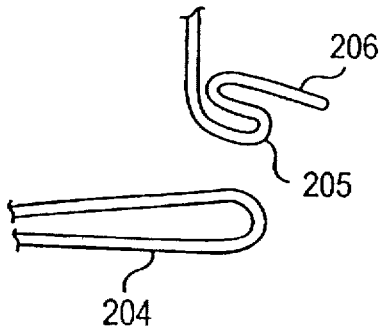

CHAIN-STITCH SEWING MACHINE WITH KNOT TYING

This is a divisional of copending application Ser. No. 08/728,123 filed on Oct. 9, 1996.

BACKGROUND OF THE INVENTION

1. Field of the Invention

The present invention relates to a method of tying a knot in chain-stitching, which is formed at the end of the chain-stitching and which cannot easily be untied, and also relates to a chain-stitch sewing machine for forming such a knot.

2. Discussion of the Related Art

Referring to FIG. 26 which shows a conventional knot in a yarn, which is formed by a single chain-stitch-type button sewing machine, the type of this knot corresponds to Class Symbols 101 and 107 which are specified in JIS (Japanese Industrial Standard)-L-0120.

As shown in FIG. 26, a button 203 is sewn onto a cloth by a single chain-stitch with the use of a yarn 201. At the final stage of sewing the button, a second loop 205, which is formed during formation of a stitch and which is one stitch ahead of the final stitch, is passed through a first loop 204 that is formed during formation of a stitch which is two stitches ahead of the final stitch, and the leading end part 206 of the yarn is passed under the second loop 205. This leading end part 206 cuts a third loop (not shown) formed during the formation of a final stitch by cutting the third loop with a cutting blade.

In this situation, the knot is never being loosened even though pulling the leading end part 206 of the yam is being pulled in the direction of the arrow A.

However, with the above-mentioned knot of the chain-stitch, if the leading end part of the yarn 206 comes off from the second loop 205, as shown in FIG. 27, the second loop 205 is likely to come off from the first loop 206 when the leading end part 206 is pulled in the direction of the arrow B, as shown in FIG. 28, and further, all loops are loosened, when the leading end part is further pulled, so that the button 203 is separated from the cloth 202.

SUMMARY OF THE INVENTION

Accordingly, the present invention is directed to a method of tying a knot in chain-stitching that substantially obviates one or more of the problems due to the limitations and disadvantages of the related art.

Additional features and advantages of the present invention will be set forth in the description which follows, and will be apparent from the description, or may be learned by practice of the invention. The objectives and other advantages of the invention will be realized and attained by the structure and process particularly pointed out in the written description as well as in the appended claims.

Accordingly, one object of the present invention is to provide a method of forming a knot in chain-stitching, which cannot be easily loosened even though a leading end part of a yarn in the knot is pulled.

Another object of the present invention is to provide a chain-stitch sewing machine which can form such a knot.

Another object of the present invention is to provide a method of forming a knot in chain-stitching, which cannot be easily loosened even though a leading end part of a yarn in the knot is pulled, and which does not significantly stick out from an article to be sewn.

To this end, according to one aspect of the present invention, there is provided a method of forming a knot in chain-stitching, comprising the step of passing a first loop of a yarn through an article to be sewn, two stitches ahead of a final stitch, then through a second loop of the yarn which is formed by sewing, one stitch ahead of the final stitch, and fastening the yarn so as to form a knot in which the first loop of the yarn is fastened by the second loop thereof.

With the method of forming a knot in chain-stitching according to the first aspect of the present invention, the one which is likely to come off is not the second loop of the yarn as in conventional method, but the first loop of the yarn, and accordingly, when such come-off occurs, the leading end part of the yarn is still held under the first loop of the yarn.

Further, if the needle location from a stitch which is two stitches ahead of the final stitch, does not vary, a conventional knot in end chain-stitching is held even though the leading end part comes off from a loop of the yarn which is nearest to the leading end part (refer to FIG. 15).

Accordingly, it is possible to form a knot which cannot be easily loosened even though the leading end part of the yarn rubs against the skin of a human body and is being pulled out.

According to a second aspect of the present invention, there is provided a method of forming a knot in chain-stitching, as described in the first aspect of the present invention, where each point of needle penetration, starting with a point at which the first loop of the yarn is formed, to the location of needle penetration of the final stitch, is spaced from the adjacent point of needle penetration by a predetermined small interval. The term "small interval" in the present invention substantially corresponds to, for example, a textile yarn or two textile yarns if the article to be sewn is a cloth.

With the knot forming method according to the second aspect of the present invention, technical effects and advantages similar to those obtained by the first aspect of the present invention, can be obtained.

Further, with this arrangement where a needle location two stitches ahead of the final stitch is spaced from a needle location one stitch ahead of the final stitch by a predetermined small interval in an article to be sewn, and where the knot is supported on the article such that it is pulled toward the article, from the needle position one stitch before the final stitch in the article, the knot does not stick out from the surface of the article. Thus, the completed article is neat and has a knot which is unnoticeable (refer to FIG. 20).

According to a third aspect of the present invention, there is provided a chain-stitch sewing machine which forms chain-stitches by a vertically movable single needle in cooperation with a rotary looper, comprising a yarn holding device for catching and releasing a single yarn of a yarn loop, and for holding the yarn loop at a predetermined position in an article to be sewn two stitches ahead of a final stitch, the yarn loop holding means catching a first loop which is pulled toward the article, two stitches ahead of the final stitch, and releasing the first loop before a second loop next to the first loop is pulled toward the article.

With the chain-stitch sewing machine according to a third aspect of the present invention, where the yarn holding device catches a single yarn of the first loop and holds it at a predetermined position, and where slack can be allowed in the length of the second loop part, in comparison with a conventional loop, the yarn can be fastened after passing the first loop through the second loop, and a knot where the first loop is fastened by the second loop can be formed.

Accordingly, technical effects and advantages similar to those obtained by the first aspect of the present invention.

According to a fourth aspect of the present invention, there is provided a chain-stitch sewing machine where chain-stitches are formed by a vertically movable single needle in cooperation with a rotary looper, comprising a yarn feed adjusting means for adjusting a degree of feed of a yarn to the single needle, the yarn feed adjusting means setting a degree of feed of the yarn during formation of a second loop which is formed by a needle position one stitch ahead of a final stitch, to be larger than that during formation of a yarn loop formed at a needle position of the final stitch and of a first loop at a needle position two stitches ahead of the final stitch.

With the chain-stitch sewing machine according to the present invention where the yarn feed adjusting means sets the degree of feed of a yarn during the formation of the second loop formed at a needle position one stitch ahead of the final stitch to a value larger than that during the formation of the yarn loop at the final stitch, and the formation of the first loop at the needle position two stitches ahead of the final stitch. Accordingly, slack can be allowed in the yarn during the formation of the second loop, a predetermined gap can be obtained between the second loop (which is paid downward to the lowest point by the rotary looper), and therefore, slack can be obtained in the length of the yarn during the formation of the second loop, unlike conventional methods. Thereby, a knot where the first loop is fastened by the second loop, can be obtained by drawing the first loop through the second loop so as to fasten the yarn. Therefore it is possible to obtain technical effects and advantages similar to those obtained by the first aspect of the present invention.

According to a fifth aspect of the present invention, there is provided a chain-stitch sewing machine, as described in the third or fourth aspect of the present invention, comprising a nipper located nearer to a needle yarn supply side than to the above-mentioned single needle, for locking the needle, and a yarn paying means for paying the needle yarn between the nipper and the single needle in a condition where the needle yarn is locked by the nipper.

With the chain-stitch sewing machine according to the fifth aspect of the present invention, a slack in the yarn can be taken up due the presence of slack, which is larger than that of a conventional approach, and accordingly, nothing interferes with the formation of a knot, in addition to the technical effects and advantages similar to those obtained by the third and fourth aspect of the present invention.

According to a sixth aspect of the present invention, there is provided a chain-stitch sewing machine, as described in the third or fourth aspect of the present invention, comprising a needle position adjusting means for obtaining a predetermined small interval at every one of needle positions from the needle position at which the first loop is formed, to the needle position of the final stitch.

According to the seventh aspect of the present invention, there is provided a chain-stitch sewing machine as described in the third or fourth aspect of the present invention, where a yarn feed adjusting means for adjusting the degree of feed of yarn to the above-mentioned single needle is provided. Instead of the above-mentioned yarn holding device, the yarn feed adjusting means sets a degree of feed of the yarn during the formation of the second loop to a value which is larger than that during the formation of a yarn loop formed at the needle position of the final stitch, and larger than that during the formation of the first loop.

With the seventh aspect of the present invention, technical effects and advantages similar to those obtained by the second aspect of the present invention can be obtained.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention that together with the description serve to explain the principles of the invention.

In the drawings:

FIG. 26 is a view illustrating a knot which is formed by a conventional single chain-stitch sewing machine;

FIG. 27 is a view illustrating a problem inherent to the knot formed by the conventional single chain-stitch sewing machine; and FIG. 28 is a view illustrating a problem inherent to the knot formed by a conventional single chain-stitch sewing machine.

DETAILED DESCRIPTION OF THE PREFERRED EMBODIMENTS

Reference will now be made in detail to the preferred embodiments of the present invention, examples of which are illustrated in the accompanying drawings.

At first, the arrangement will be explained in detail.

Figure 1:
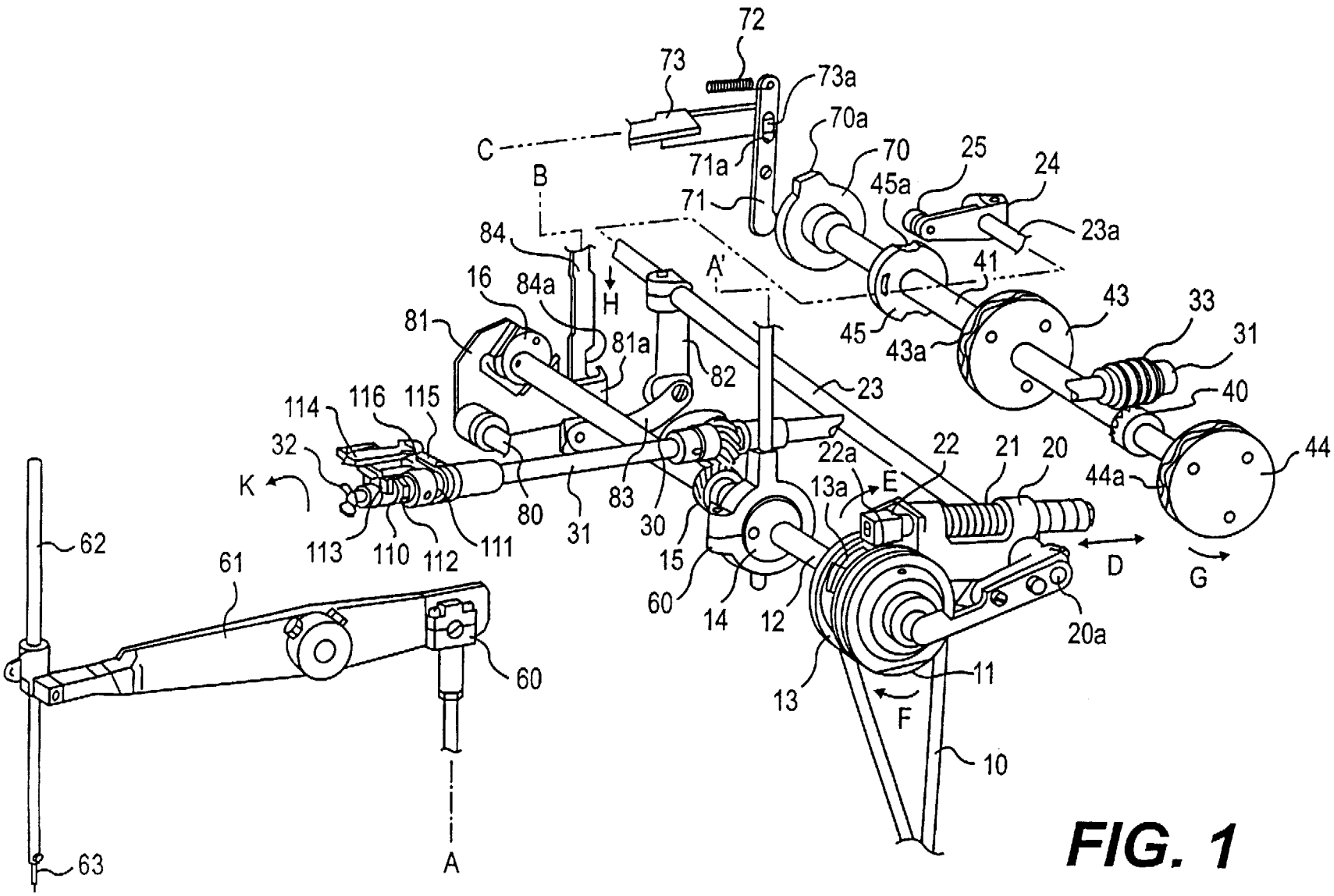
FIG. 1 is a perspective view illustrating a sewing machine for sewing a button by single chain-stitching in a first embodiment of the present invention.
Figure 2:
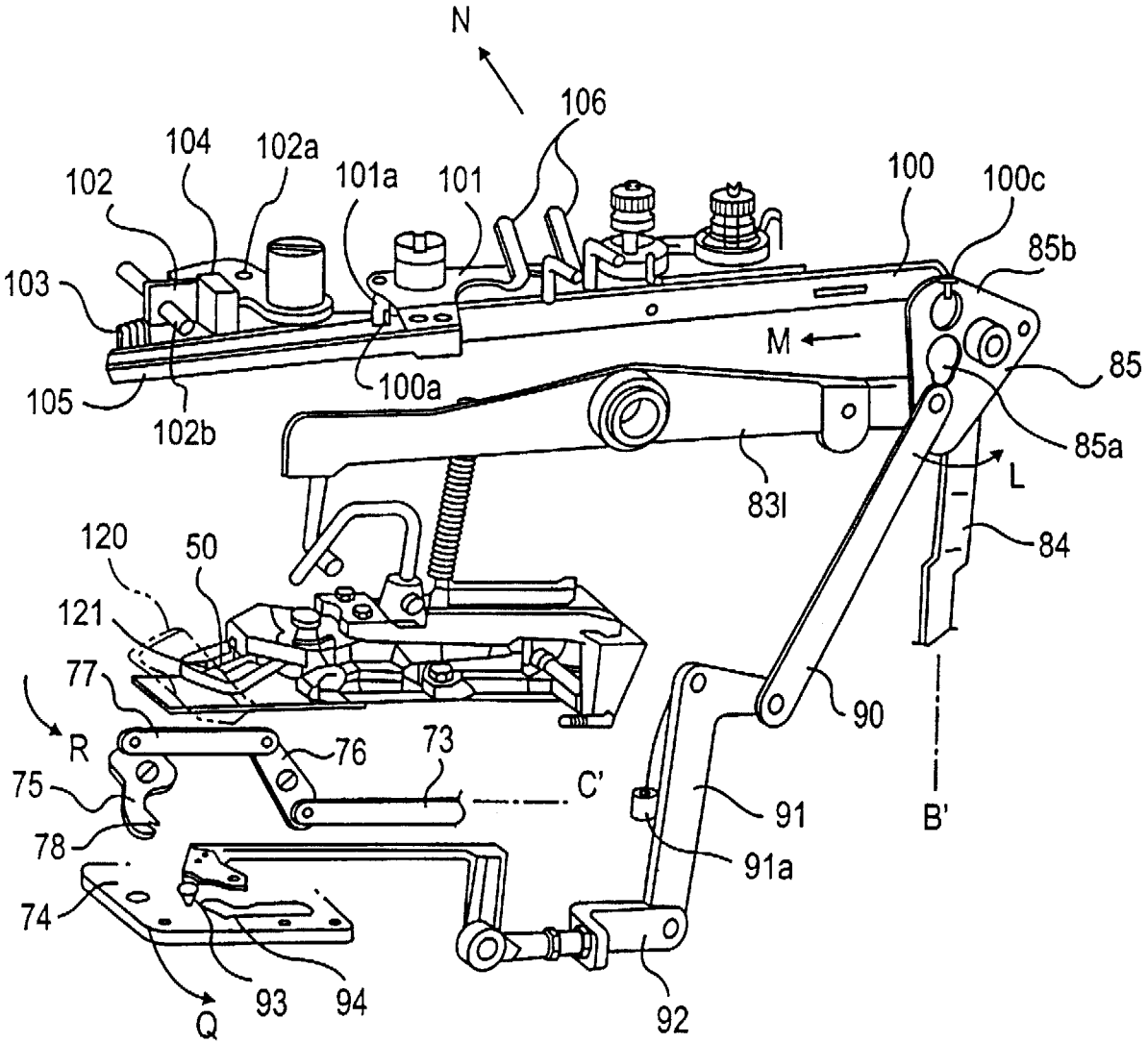
FIG. 2 is a perspective view illustrating the sewing 15 machine for sewing a button by single stitching according to the first embodiment of the present invention.

Referring to FIGS. 1 and 2 which are perspective views showing a single chain-stitch button sewing machine in a first embodiment of the present invention, and where the single chain-stitch button sewing machine is divided into two parts which are respectively shown in these drawing. For the sake of convenience, broken lines A and A', broken lines B and B' and the broken lines C and C are conveniently separated from each other.

Referring to FIG. 1, a torque is transmitted from a drive source (not shown), to a drive pulley 11 through the intermediary of a belt 10. The drive pulley 11 is rotatably attached to the drive shaft 12 to which a cut-off cam 13, an eccentric cam 14, a helical gear 15 and a yarn cutting cam 16 are fixed. A cut-off frame 20 which is rotatably attached to a sewing machine frame (not shown), and a cut-off hook 22 is provided to the front end part of the cut-off frame 20 through the intermediary of a cushion member 21 so as to be slidable in the direction of the arrow D, and the front end part 22*a* of the cushion member is locked to a cam part 13*a* of the cut-off cam 13.

A cut-off shaft 23 is fixed to a fulcrum 20*a* of the cut-off frame, and a cut-off control arm 24 is fixed to the other end of the cut-off shaft 23. A helical gear 30 is meshed with the helical gear 15, and is fixed thereto with a looper shaft 31. A rotary looper 32 is fixed to one end of the looper shaft 31, and a worm 33 is fixed to the other end thereof.

A worm gear 40, meshed with the worm 33, is fixed to a cam shaft 41 which is in turn fixed thereto with a lateral feed cam 43, a longitudinal feed cam 44 and a cut-off control cam 45. A roller 25, attached to a trailing end part of the cut-off control arm 24, abuts against a cam part 45*a* of the cut-off control cam 45. Pins, which are not shown, are engaged in a groove part 43*a* formed in the lateral feed cam 43, and a groove part 44*a* formed in the longitudinal feed cam 44, respectively. The motions of these pins along the shapes of the groove parts 43*a*, 44*a* are transmitted through the intermediary of a link mechanism (which is well-known so that detailed description of one is omitted) so as to horizontally move a button clamp 50 (refer to FIG. 2) in order to adjust a needle position with respect to a button clamped by the button clamp 50. A crank rod 60 is connected at its one end to the eccentric cam 14 and is rotatably coupled at the other end to a needle drive lever 61 rotatably fitted to a sewing machine frame. A needle 63 is provided inside a needle rod 62 located at one end of the needle drive bar 61.

A yarn tying cam 70 is attached to one end of the cam shaft 41, and a cam surface 70*a* overhangs the yarn tying cam 70. A yarn tying arm 71, rotatably attached to the sewing machine frame, is applied with an urged torque by a spring 72 so as to abut against the cam surface 70*a* of the yam tying cam 70 at its one end. An elongated hole 71*a* is formed in the other end of the yarn tying arm 71, and a rolled projection 73*a* formed at one end of a link 73 is fitted in the elongated hole 73. Referring to FIG. 2, the link 73 is rotatably fixed at its other end to a proximal end part of a yarn tying plate 75 through the intermediary of a lever 76 and a link 77. The yarn tying plate 75 is rotatably fixed to the needle plate 74, and the trailing end part of the yarn tying plate 75 is formed therein with a yarn hooking device 78.

Referring to FIG. 1, bifurcated parts of a bifurcated rod 81, rotatably fixed to the shaft 80 which is fixed to the sewing machine frame, incorporate a hook part 81*a* of the bifurcated rod 81.

A rod 82 is fixed at its upper end to the cut-off shaft 23, and is rotatably coupled at its lower end with one end of a link 83. A pull-up plate 84 is rotatably fixed at its lower end to the other end of the link 83. A hook part 84*a* is formed in the pull-up plate 84.

Referring to FIG. 2, a triangular plate 85 rotatably attached to the sewing machine frame (not shown) is formed therein with a groove part 85*a* which is fitted therein with a bearing member (not shown) which coaxially supports the upper end of the pull-up plate 84, the upper end of a link 90 and one end of a pull-up lever 831. An L-like link 91 is rotatably coupled at its one to the lower end of the link 90, and one end of a link 92 is rotatably fixed to the other end of the link 91. The intermediate part of the link 91 is rotatably attached to a stationary member fixed to the sewing machine frame. Further, the other end of the link 92 is coupled to a movable knife 93 rotatably supported on the needle plate 74, and a stationary knife 94, fixed to the needle plate 47, is adapted to be meshed with the movable knife 93 so as to cut a yarn during rotation of the movable knife 93.

Figure 3:
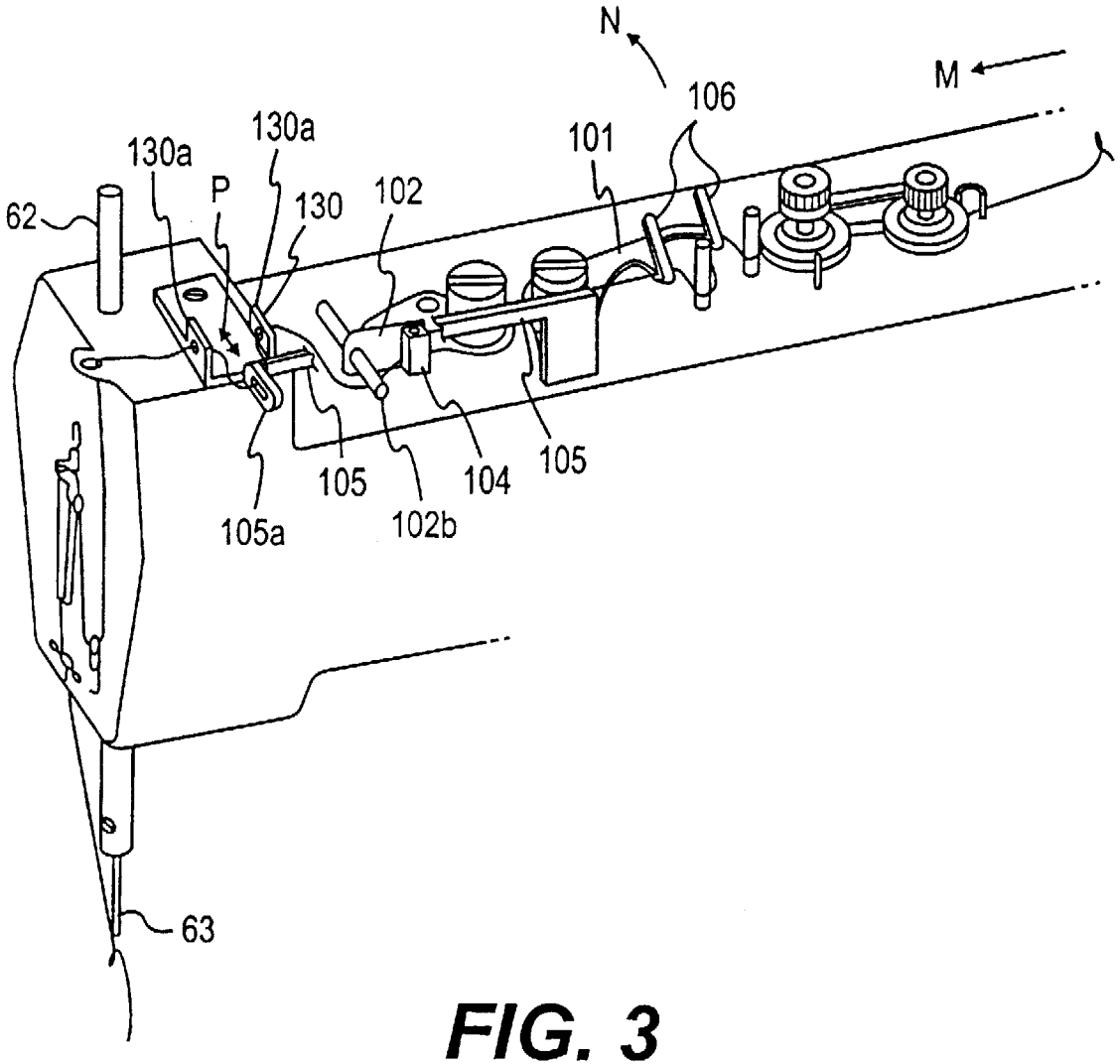
FIG. 3 is a perspective view illustrating an arm in the sewing machine for sewing a button by single chain-stitching according to first embodiment of the present invention.

Referring to FIGS. 2 and 3, a curved part 100*c* formed at one end of a coupling rod 100 is slidably engaged in a groove part 85*b* formed in the triangular plate 85. The coupling rod 100 is slidably supported longitudinally to the sewing machine frame, and a cam part 101*a* of a yarn adjusting lever 101 rotatably fixed to the sewing machine frame is fitted in a groove 100*a* formed in the coupling rod 100.

Further, a spring 103 is stretched between a spring hook fixed to the coupling rod 100, and a predetermined spring hook part of a nipper 102 which is rotatably fixed to the sewing machine frame. A nipper rectangular piece 104 is rotatably fixed to the sewing machine frame, abutting against a retainer part 102*b* of the nipper 102. The yam adjusting lever 101 is adjustably attached thereto with a yarn pay-off arm 105 (yarn pay-off means). The yam pay-off arm 105 is attached at its rear end to the yarn adjusting lever 101, and has a front part 105*a* (yarn locking part) which is ring-like. A yarn engaging member 130 has two holes 130*a*, 130*a* for threading the yarn in both end protrusions, and is provided in a yam path in the sewing machine frame. Further, the yarn pay-off arm 105 swings in a direction P between both end protrusions of the yarn engaging member 130 so as to change the yarn path. Thus, the yarn between the needle 63 and the nipper 102 can be paid off.

Referring to FIG. 1, an outer peripheral cam 110 and a groove cam 111 are fixed in the vicinity of the rotary looper 32 on the looper shaft 31. A draw-up support 113 is slidably attached to a guide plate 112 and fixed to the sewing machine frame, and the bifurcated parts are fitted in the outer peripheral cam 110. Further, a yarn draw-up 114 is slidably attached to the draw-up support 113. An elongated hole is formed in one end of the yarn draw-up 114, and a roller 116, attached to one end of a longitudinal arm 115, which is rotatably attached to the sewing machine frame (not shown), is fitted in the elongated hole. This roller 116 is also fitted in a cam part of the groove cam 111. With this arrangement, the yarn draw-up 114 can carry out a planar motion which is determined by the outer peripheral cam 110 and the groove cam 111.

Next, explanation will be made of the operation.

Referring to FIGS. 1 to 3, when start lever (not shown) is depressed, the cut-off frame 20 is turned in the direction E, the engagement between the cut-off hook 22 and the cam part 13*a* is released, and simultaneously the drive pulley 11 and the rotary shaft 12 are coupled together by a cut-off mechanism (not shown), so as to start rotation in a direction F.

Accordingly, the cam shaft 41 is also rotated in a direction G, the rolls 25 of the cut-off control arm 24 ride up on the cam part 45*a* of the cut-off control cam 45, and accordingly, even though the above-mentioned start lever is released, the cut-off hook 22 cannot be turned a direction reverse to the direction E so that the rotation of the drive shaft 12 is held.

The needle drive lever 61 is swung by means of a crank rod 60 due to the rotation of the eccentric cam 41, and the needle rod 62 is moved vertically. The looper 32 is attached to the front end of the looper shaft 31. This motion, together with the rotation of looper 32 in a direction K, and the operation of the yarn draw-up 114, in combination form a single chain-stitch.

That is, with the above-mentioned motion, and the motion of the button clamp 50 through the rotation of the lateral and longitudinal feed cam 44, the needle 63 falls in button holes in the button 121 on a cloth 120 in a predetermined order so that a single chain-stitch is formed.

When the roller 25 comes onto the cam part 45*a* of the cut-off control cam 45, the cut-off frame 20 is rotated in a direction reverse to the direction E, and accordingly, the cut-off hook 22 abuts against the cut-off cam 13. At this time, the connection between the drive pulley 11 and the drive shaft 12 is released, and thereafter, the drive shaft 12 is rotated by its inertia, the cut-off hook 22 and the cam part 13*a* of the cut-off cam 13 abut against each other so that drive shaft 12 comes to a stop.

Further, the hook part 84*a* of the pull-up plate 84 engages the hook part 81*a* of the bifurcated rod 81, and accordingly, pull-up plate 84 is moved in a direction H.

Accordingly, the triangular plate 85 is rotated in the direction L so as to move the coupling rod 100 in a direction M, and therefore the yarn adjusting lever 101 is rotated in a direction N so that the yarn between the yarn guide 106 and itself is paid off. Further, the nipper 102 is also rotated in a direction P by means of the spring 103, and the yarn between the nipper rectangular piece 104 and itself is retained.

Further, the yarn between the nipper 102 and the needle 63 is paid off by the cam part 101*a* of the yarn adjusting plate 101.

Further, the movable knife 93 is rotated in a direction Q by means of the links 90, 91 and 92, and accordingly, it meshes with the stationary knife 94 so that the yam is cut.

Before this motion, when the one end of the yarn tying arm 71 comes up onto the protrusion 70*a* of the yarn tying cam 70, the yarn tying plate 75 is rotated in a direction R, by means of the links 73, 76 and 77. After it is held for a predetermined period, when it finishes coming up onto the protrusion 70*a*, it is returned to its original position.

Further, the yam tying cam 70 is fixed so as to be adjustable in the rotating direction with respect to the cam shaft 41.

The explanation has been briefly made of the operation of the sewing machine according to the first embodiment of the present invention with reference to FIGS. 1 to 3. A stitch forming condition two stitches ahead of the needle position (final stitch), obtained when the yarn is cut at the final stage of button sewing by single chain-stitch sewing, the cooperating relationship and the positional relationship among the needle 63, the rotary looper 32, the yarn draw-up 114 and the yarn hooking device 78 will be explained step by step. FIGS. 4(A) to 13(A) are step by step sectional views of the formation of the knot, while FIGS. 4(B) to 13(B) are perspective isometric views of the formation of the knot.

Figure 4A:
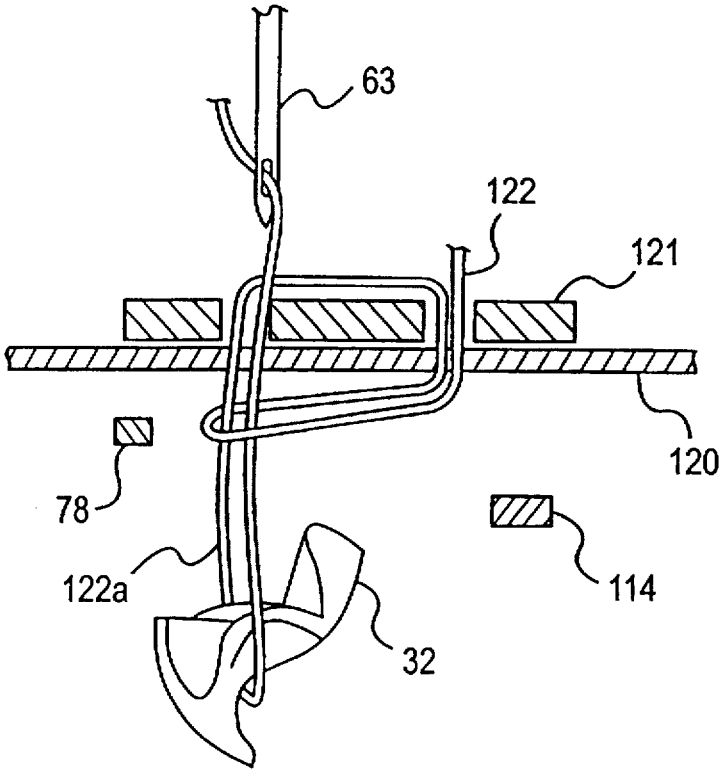
FIGS. 4(A) and 4(B) are views showing a process of forming a knot according to the first embodiment of the present invention.
Figure 4B:
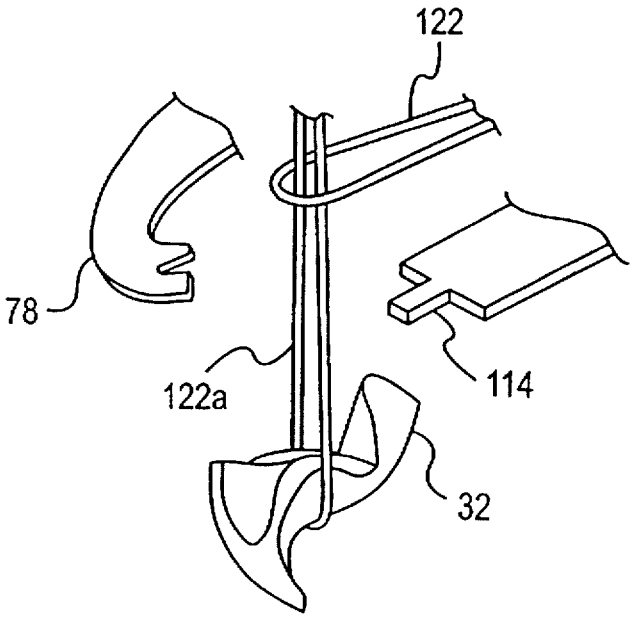
Figure 5A:
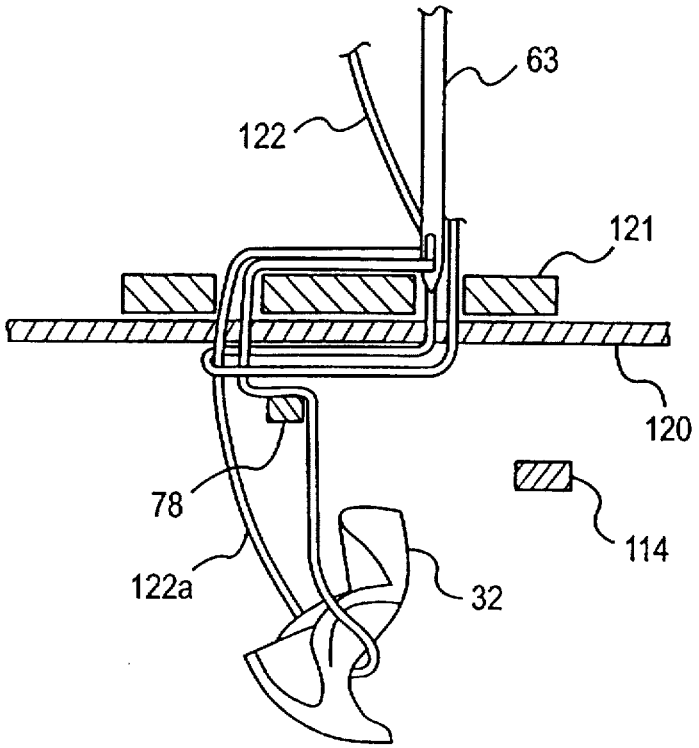
FIGS. 5(A) and 5(B) are views showing the process of forming the knot according to the first embodiment of the present invention.
Figure 5B:
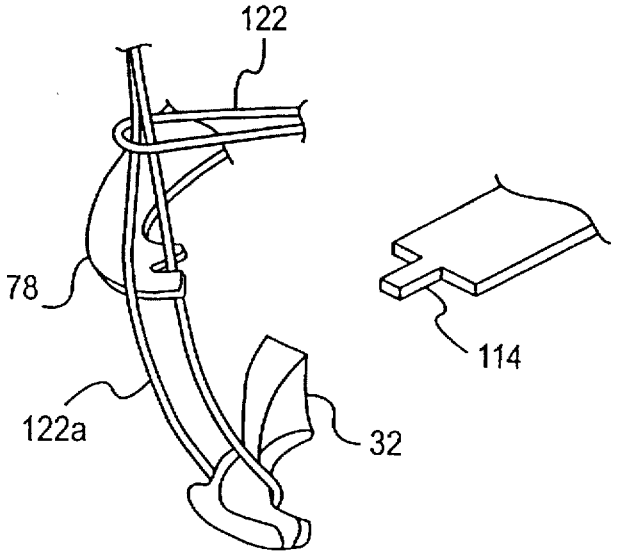
Figure 6A:
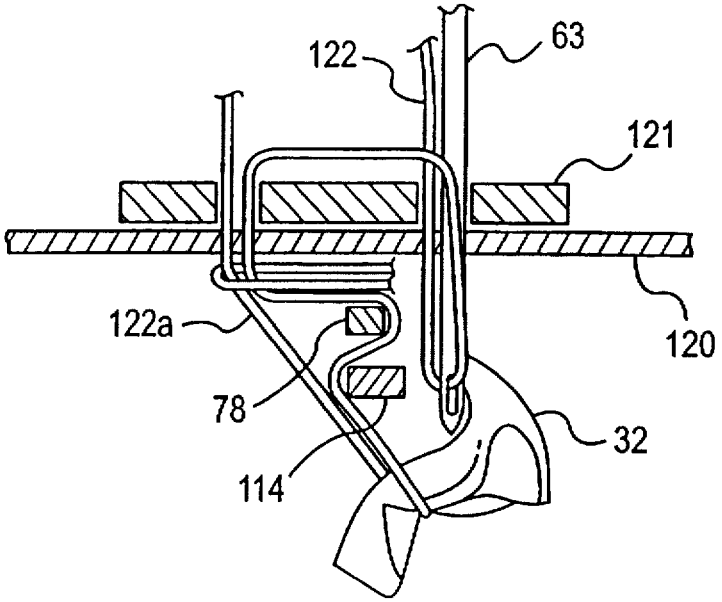
FIGS. 6(A) and 6(B) are views showing the process of forming the knot according to the first embodiment of the present invention.
Figure 6B:
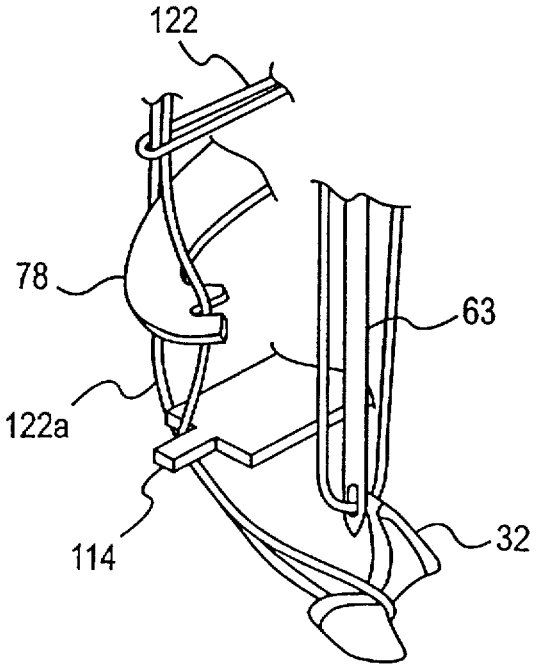

At first, FIGS. 4(A) and 4(B) show a sewing condition at a position where the needle 63 is raised upmost, two stitches ahead of the final stitch. A first loop 122*a* is formed by the looper 32 which catches the needle yarn 122 at a needle position two stitches ahead of the final stitch. Next, the needle 63 is located above the point of penetration (e.g., another button hole) one stitch ahead of the final stitch. A single yarn forming the first loop 122*a* is caught (refer to FIGS. 5(A) and 5(B)) with the use of a yarn hooking device 78 (the yarn hooking means). At the needle position one stitch ahead of the final stitch, the needle yam 122 is started, being caught by the looper 32, and the yarn draw-up 114 draws up the first loop 122*a* toward one side from the lower part of the yarn hooking device 78, and the yarn hooking device 78 holds the first loop 122*a* at the predetermined position (refer to FIGS. 6(A) and 6(B)). In this condition, the yarn slacks so that the length of the yarn which forms the first loop 122*a* is longer than that formed by a conventional method. Thereafter, the needle 63 ascends so that the yarn draw-up 114 moves away from the first loop 122*a*, and the looper 32 catches the yarn 122 so as to pass it under the first loop 122*a* in order to form a second loop 122*b*.

Figure 7A:
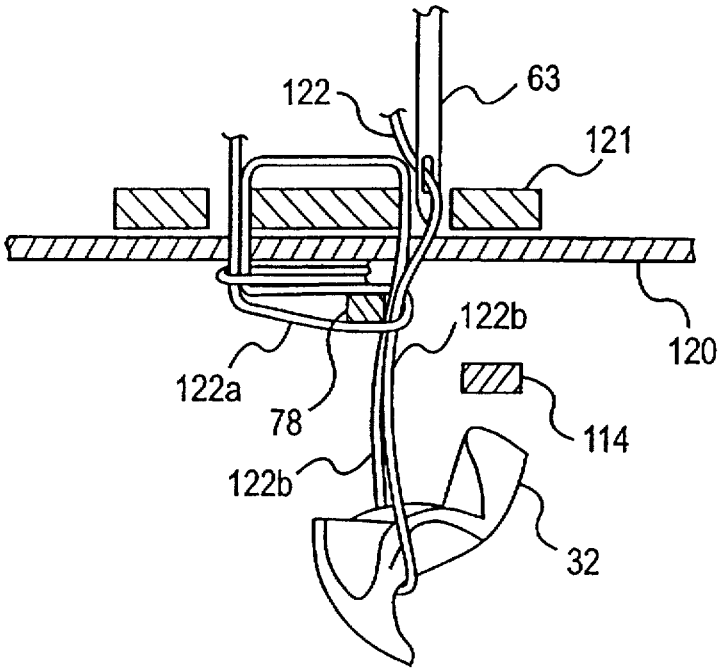
FIGS. 7(A) and 7(B) are views showing the process of forming the knot according to the first embodiment of the present invention.
Figure 7B:
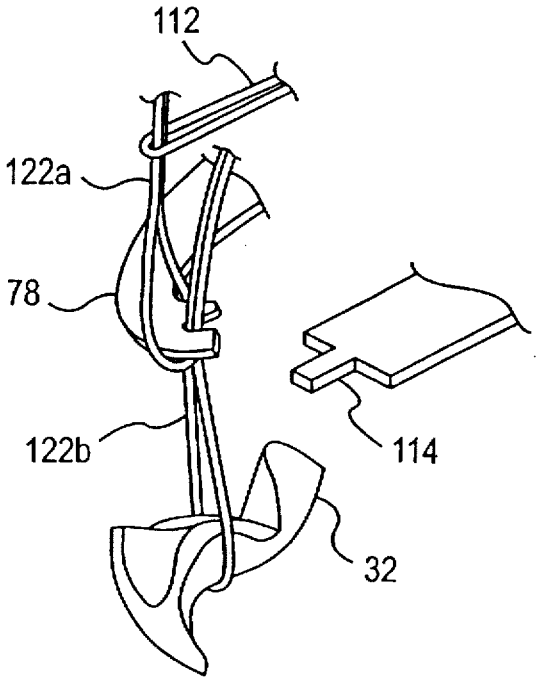

Then, the first loop 122*a* moves away from the looper 32, and the needle 63 ascends (FIGS. 7(A) and 7(B)).

Figure 8A:
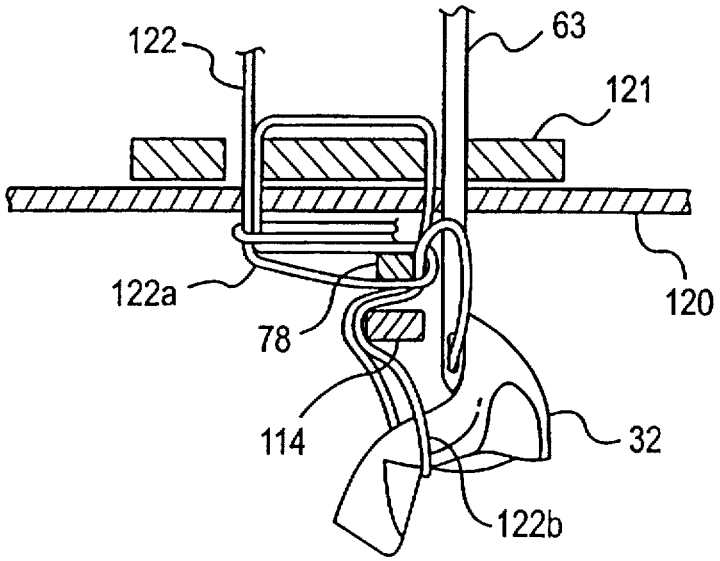
FIGS. 8(A) and 8(B) are views showing the process of forming the knot according to the first embodiment of the present invention.
Figure 8B:
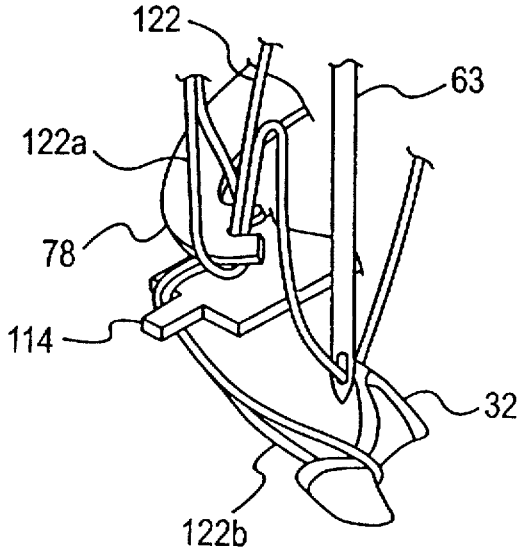
Figure 9A:
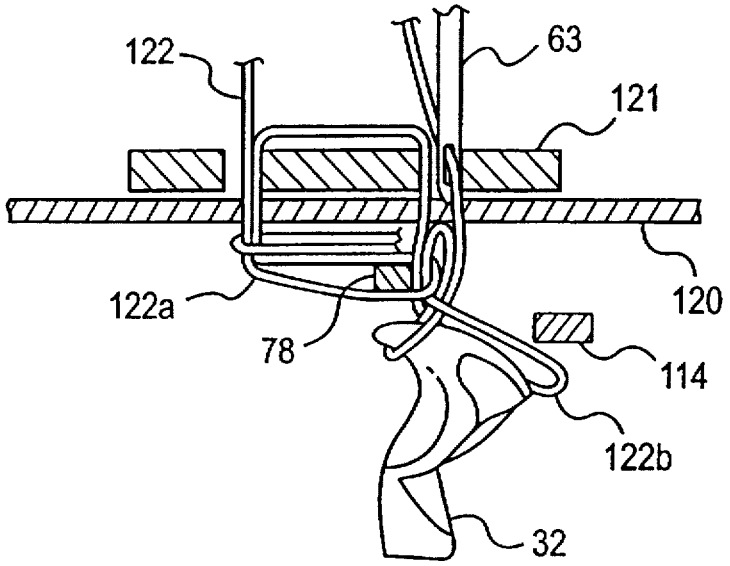
FIGS. 9(A) and 9(B) are views showing the process of forming the knot according to the first embodiment of the present invention.
Figure 9B:
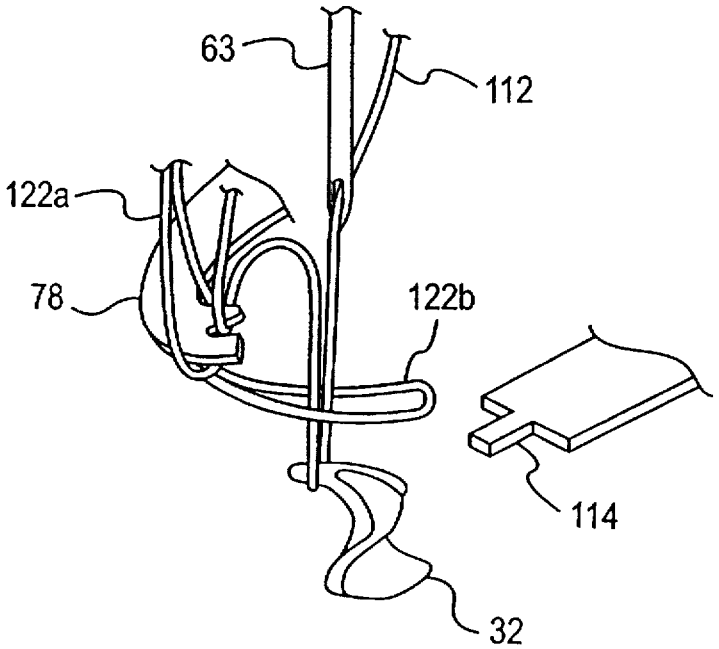
Figure 10A:
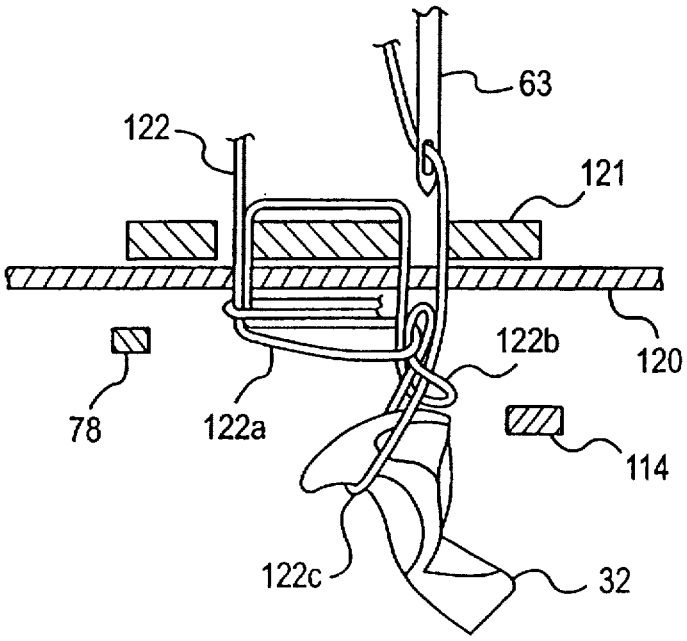
FIGS. 10(A) and 10(B) are views showing the process of forming the knot according to the first embodiment of the present invention.
Figure 10B:
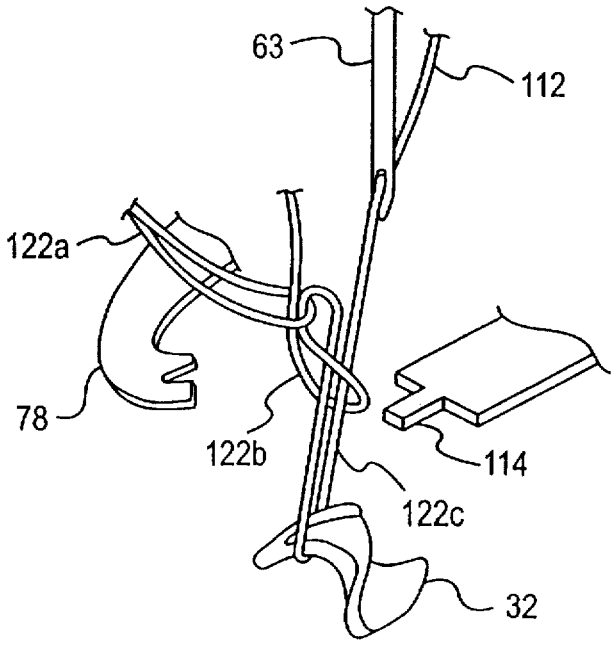

At this time, the final stitch begins to be formed in a button hole which is the same hole as the hole one stitch ahead thereof, and the yarn draw-up 114 draws the second loop 122*b* toward one side while the looper 32 starts catching the needle yarn 122 (FIGS. 8(A) and 8(B)). Next, the looper 32 starts passing the needle yarn 122 under the second loop 122*b*, and the yarn draw-up 114 moves away from the second loop 122*b* (FIGS. 9(A) and 9(B)).

Thereafter, the yarn hooking device 78 releases the second loop 122*b* before it is drawn up to the cloth 120. Thus, a third loop 122*c* passing under the second loop 122*b*, is formed (FIGS. 10(A) and 10(B)).

Figure 11A:
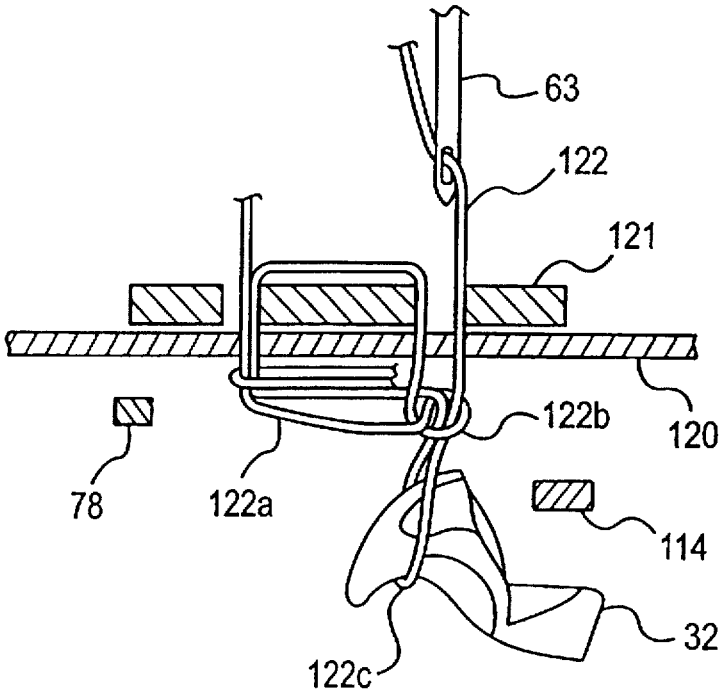
FIGS. 11(A) and 11(B) are views showing the process of forming the knot according to the first embodiment of the present invention.
Figure 11B:
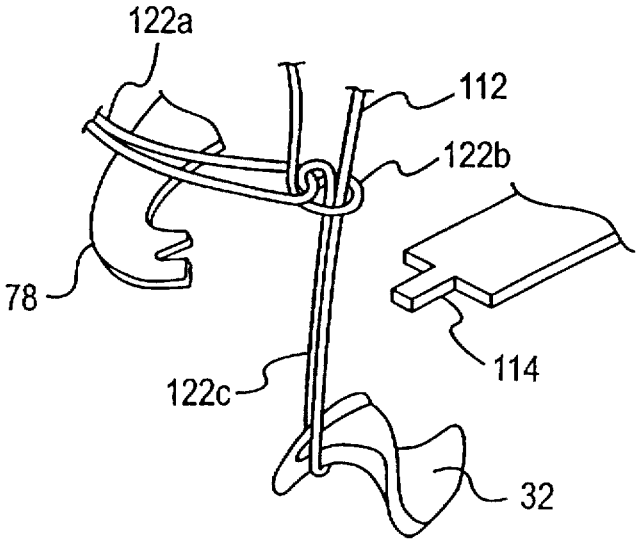
Figure 12A:
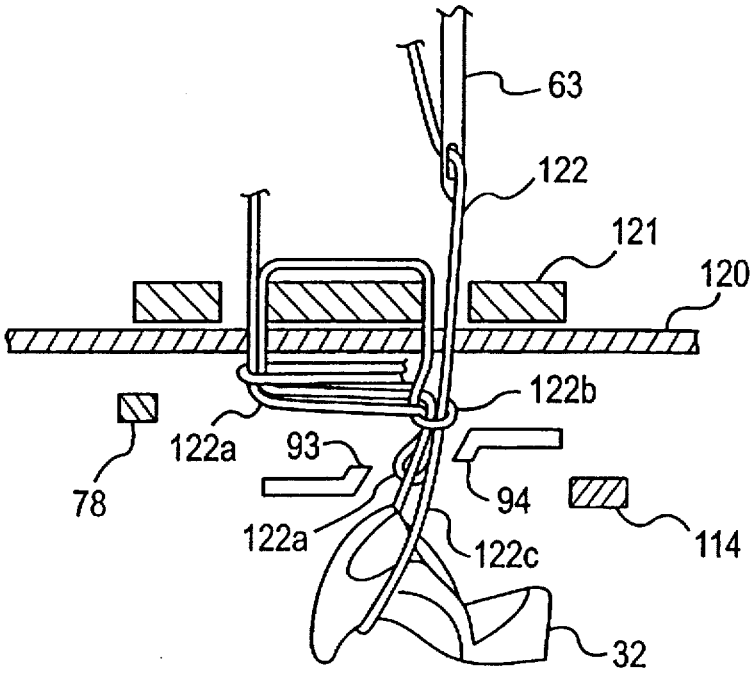
FIGS. 12(A) and 12(B) are views showing the process of forming the knot according to the first embodiment of the present invention.
Figure 12B:
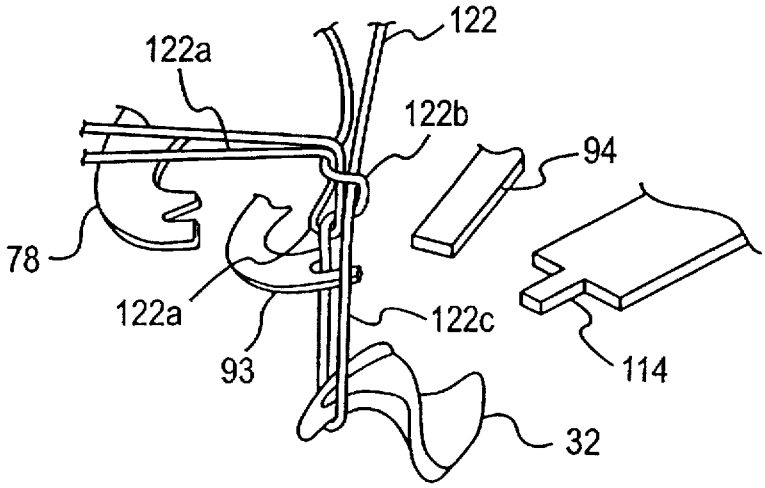
Figure 13:
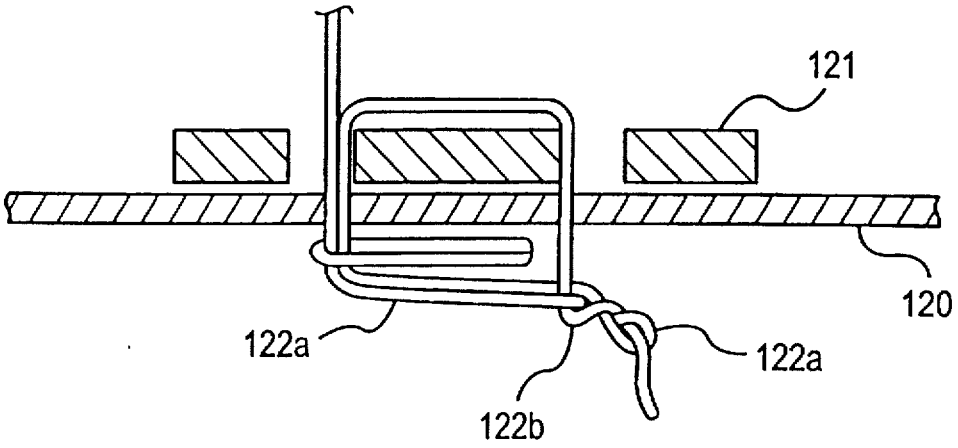
FIG. 13 is a view illustrating a knot formed by the first embodiment of the present invention.
Figure 14A:
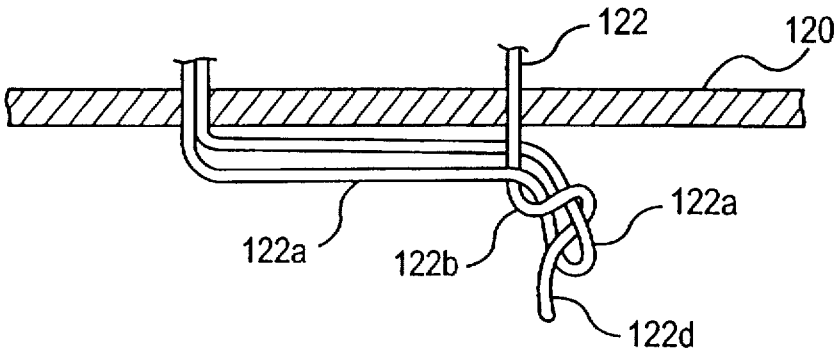
FIGS. 14(A) to 14(C) are views illustrating a knot formed by the first embodiment of the present invention.
Figure 14B:
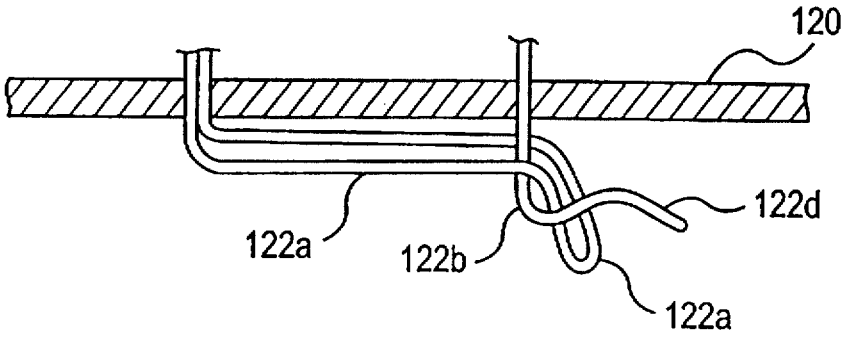
Figure 14C:
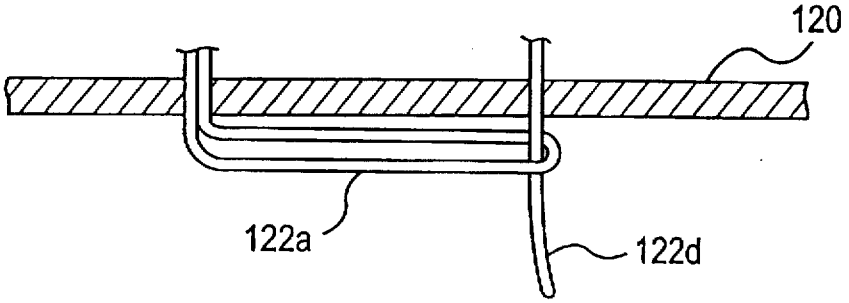

Further, the needle 63 ascends, and the third loop 122*c* is pulled down (FIGS. 11(A) and 11(B)). As mentioned above, the yarn hooking device 78 holds a single arc of the second loop 122*b* at a predetermined position after the yarn is caught, and slackens the yarn, and since the length of the yarn in the second loop 122*b* is longer than that obtained by a conventional method, the first loop 122*a* is also drawn together with the third loop 122*c*, passing under the second loop 122*b* (FIGS. 12(A) and 12(B)). In this condition, the third loop 122*c* is pulled down, and when the third loop 122*c* is cut by the movable knife 93 and the stationary knife 84, a knot in which knot part formed by the first loop 122*a* is fastened by a knot part formed by the second loop 122*b* can be formed (FIG. 13). Referring to FIG. 14, an end part 122*d* (FIG. 14(A)) of the yarn of the thus formed knot does not come off from the second loop 122*b*, but comes off from the first loop 122*a* (FIG. 14(B)). Even in this case, the end part 122*d* of the yarn having come off from the first loop is in a situation where it passes under the first loop 122*a* (FIG. 14(C)).

Accordingly, even though the end part 122*d* of the yarn is pulled, being rubbed against the skin of the human body, the end part 122*d* of the yarn does not come off from the second loop 122*b*, and accordingly, a knot is formed which cannot be easily loosened.

Further, the yarn adjusting lever 101 is turned so as to draw the needle yarn more or less as in the above-mentioned sewing machine during conventional cutting of the yarn. In this situation, the yarn is retained by the retaining part 102*b* of the nipper 102 and the nipper rectangular piece 104. This is due to slack formed in the yarn when sewing starts, and accordingly, the yarn is more or less drawn.

However, as mentioned above, the slack of the yarn is larger than that obtained by a conventional chain-stitch sewing machine, due to the operation of the yarn hooking device 78.

Accordingly, in order to increase the drawing of the yarn, the yarn pay-off arm 105 is attached to the yarn adjusting plate 101. Thus, the yarn between the needle 63 and the nipper 102 can be paid off. With the above-mentioned arrangement, the yarn can be sufficiently drawn even though the slack of the yam is large, and accordingly, the knot can be fastened up.

Figure 15A:
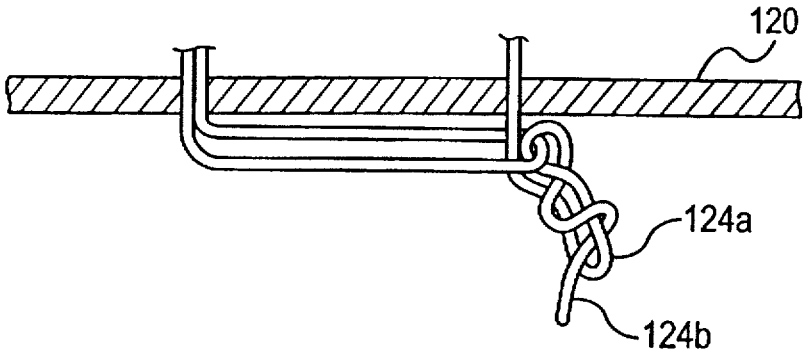
FIGS. 15(A) to 15(C) are views illustrating a knot formed by the first embodiment of the present invention.
Figure 15B:
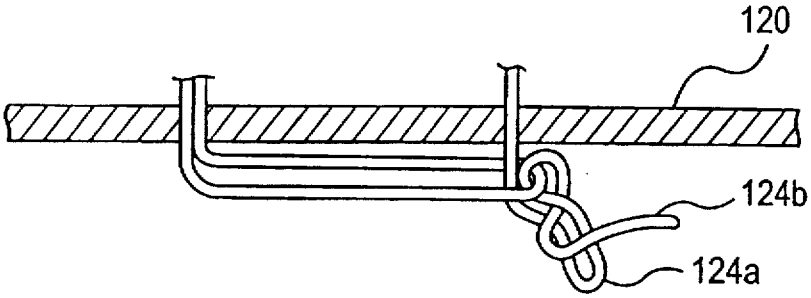
Figure 15C:
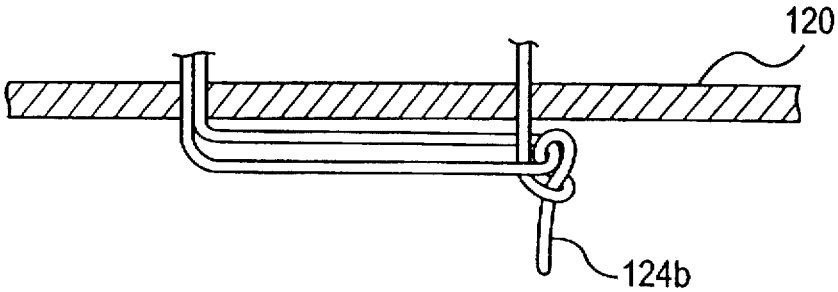

It is noted that FIG. 15(A) shows stitches in the case where the needle 63 drops at the same position as that of the final stitch from a stitch two stitches ahead of the final stitch. As shown in FIG. 15(B), even though the end part of the yarn comes off from the loop 124*a*, a knot in conventional single chain-stitching can be obtained as shown in FIG. 15(C), and accordingly, the stitches are harder to loosen than those of the first embodiment of the present invention.

Explanation will be made of a second embodiment of the present invention.

The arrangement of a sewing machine for sewing a button by single chain-stitching, as in the second embodiment of the present invention, is substantially similar to that of the first embodiment of the present invention, and accordingly identical reference numerals are used to refer to common elements of those of the first embodiment.

In this embodiment of the present invention a stitch three stitches ahead of the final stitch is formed in one of button holes so as to form a yarn loop, and the next stitch is formed in another button hole so as to form a first loop passing under this yarn loop, and the next stitch is formed in the same button hole, being shifted by a predetermined small interval (corresponding to one or two of textile yams in the cloth), and is passed under the first loop so as to form a second loop. The final stitch is formed in the same button hole, being spaced from the needle position of the first loop with a predetermined small interval (corresponding to one or two of textiles in the cloth) so as to form a third loop. Then the first and second loops are fastened while the third loop is cut, thereby forming a knot. In this case, the first loop is held at a predetermined position by the yarn hooking device 78, and the second loop is passed under the first loop.

The embodiment described above can be realized by changing, in the structure shown in FIGS. 1 to 3, the shapes of grooves in the longitudinal cam 43 and the lateral cam 44, the structure of the yarn tying cam 70, and the like. Further, in the second embodiment of the present invention, no yarn draw-up arm 105 is provided. However, the other arrangements are similar to that of the first embodiment of the present invention, and accordingly, detailed illustration and explanation thereof are omitted.

Next, explanation will be made of the operation.

Figure 16A:
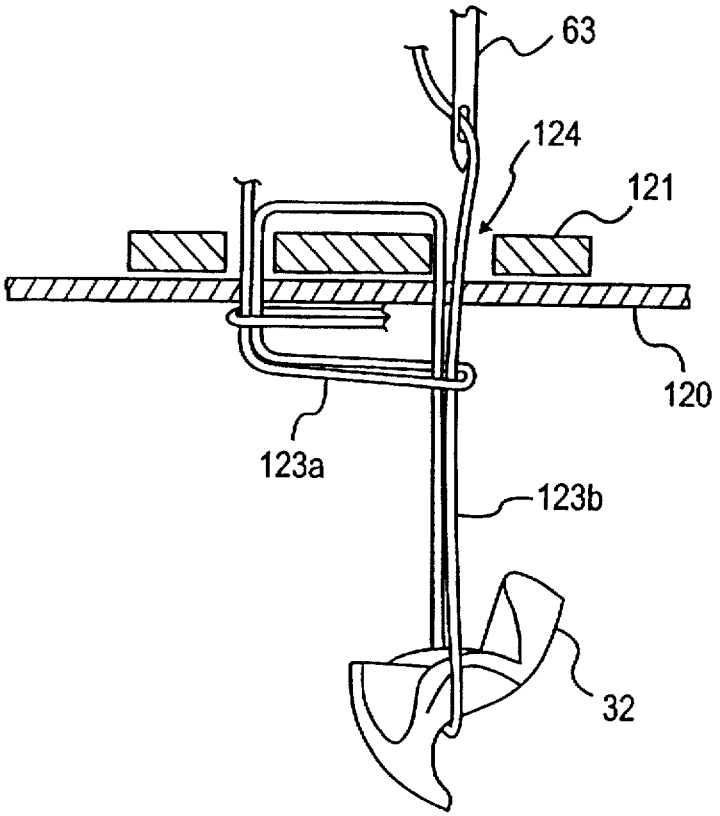
FIGS. 16(A) and 16(B) are views illustrating a knot formed by a second embodiment of the present invention.
Figure 16B:
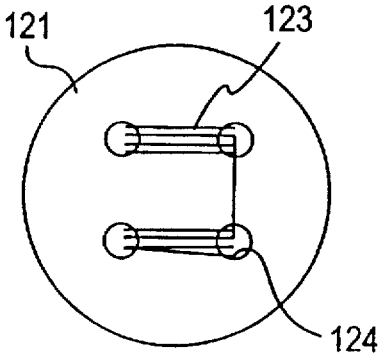

The formation of the knot will be first explained in order. FIGS. 16 to 18 explain the formation of the knot step by step. FIGS. 16(A) to 18(A) are sectional views, while FIGS. 16(B) to 18(B) are plan views. At first, a yarn loop 123*a* is formed in one of button holes in a button 121 at a needle position three stitches ahead of the final stitch, in cooperation with the needle 63 and the looper 32, and then, the next stitch (at needle position 124) is formed in the other button hole so as to form a first loop 123*b* (FIGS. 16(A) and 16(B)).

Figure 17A:
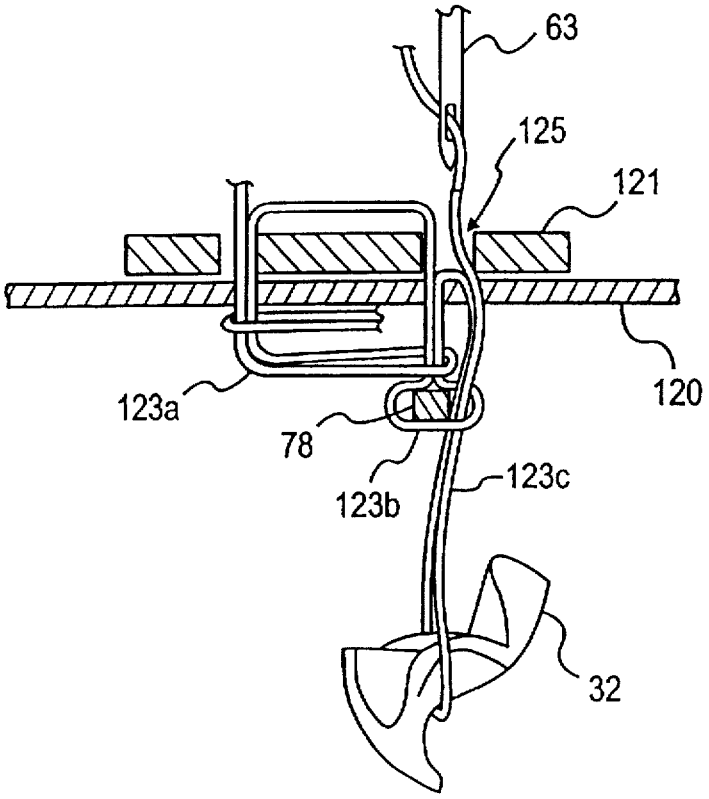
FIGS. 17(A) and 17(B) are views showing a process of forming the knot according to the second embodiment of the present invention.
Figure 17B:
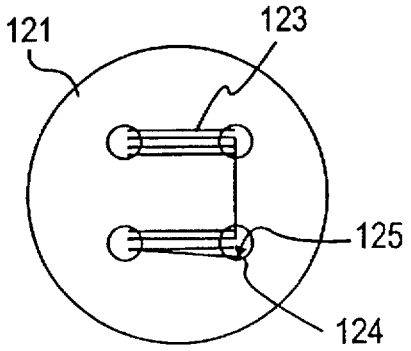
Figure 18A:
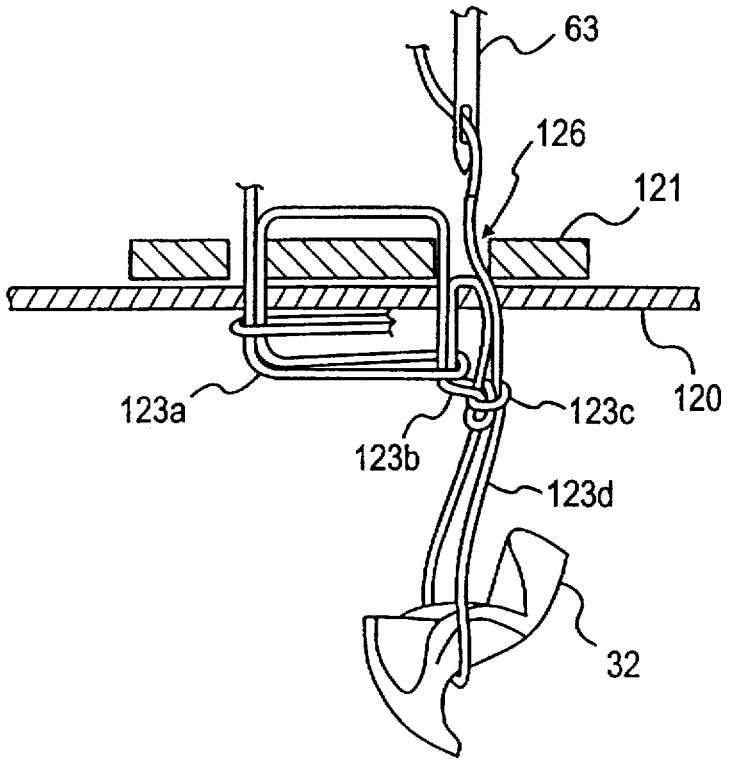
FIGS. 18(A) and 18(B) are views showing the process of forming the knot according to the second embodiment of the present invention.
Figure 18B:
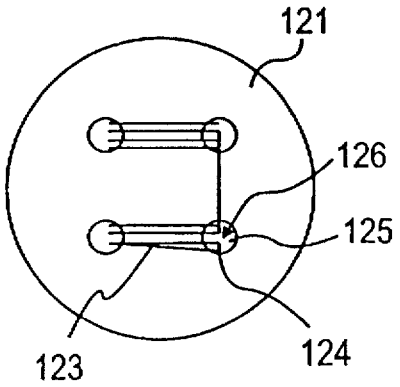
Figure 19:
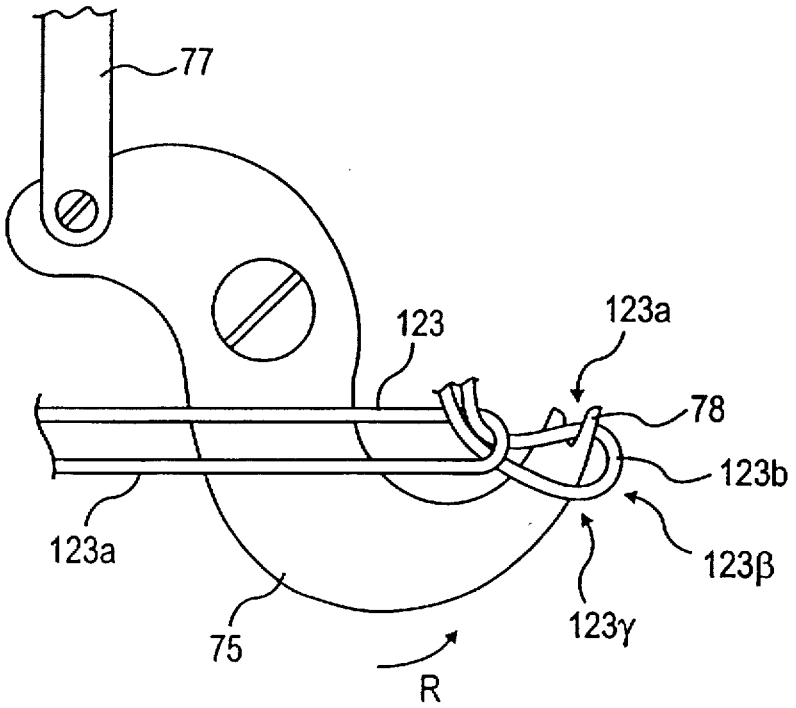
FIG. 19 is a view showing effects according to the second embodiment of the present invention.
Figure 20:
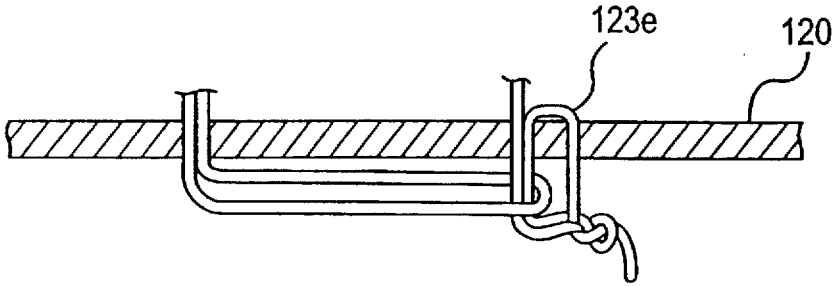
FIG. 20 is a view illustrating the knot formed according to the second embodiment of the present invention.

Next, a single yarn of the first loop 123*b* is held at a predetermined position by the yarn hooking device 78, the next stitch (needle position 125) is formed in the button hole the same as the needle position 124, at a position separated from the needle position 124 by a predetermined small interval (corresponding to one or two textile yarns in the cloth) so as to form a second loop 123*c* (FIGS. 17(A) and 17(B)). FIG. 19 is a plan view illustrating a yarn tying plate 75 in a situation where the first loop 123*b* is caught.

Next, the final stitch (needle position 125) is formed in the same button hole, at a position separated from the needle position 124 by a predetermined small interval (corresponding to one or two textile yarns in the cloth), and is passed through the second loop 123*c* so as to form a third loop 123*d* (FIG. 18). Then, the third loop 123*d* is cut so that a knot composed of the first and second loops is formed.

This knot may be a variant form of the knot shown in FIG. 15, and the knot is pulled toward and supported on the cloth by a loop 123*e* so that the knot does not stick out from the surface of the cloth 120, that is, the knot is not noticeable and accordingly, the completed sewing is neat.

It is noted that in the above-mentioned second embodiment of the present invention, the final stitch (needle position 125) is formed at a position separated from the needle position 124 by a predetermined small distance. However, instead of this arrangement, even though the needle position 124 and the final stitch may be located at one and the same position, a knot which cannot be easily loosened, can be formed.

Explanation will be made of a third embodiment of the present invention.

In the first and second embodiments of the present invention, the loop 122*a* as shown in FIG. 13 is held at a position slightly below the cloth 120 using a yarn tying plate 75. Instead of the yarn tying plate 75 in the first and second embodiment of the present invention, the supply volume during the formation of a loop (b) is set to be greater than that during the formation of a loop (not shown in FIG. 13) formed at the needle position and a loop 128*a* so as to adjust the position of the loop 122*a* by stopping the lift-up of a balance or paying it out.

Figure 21:
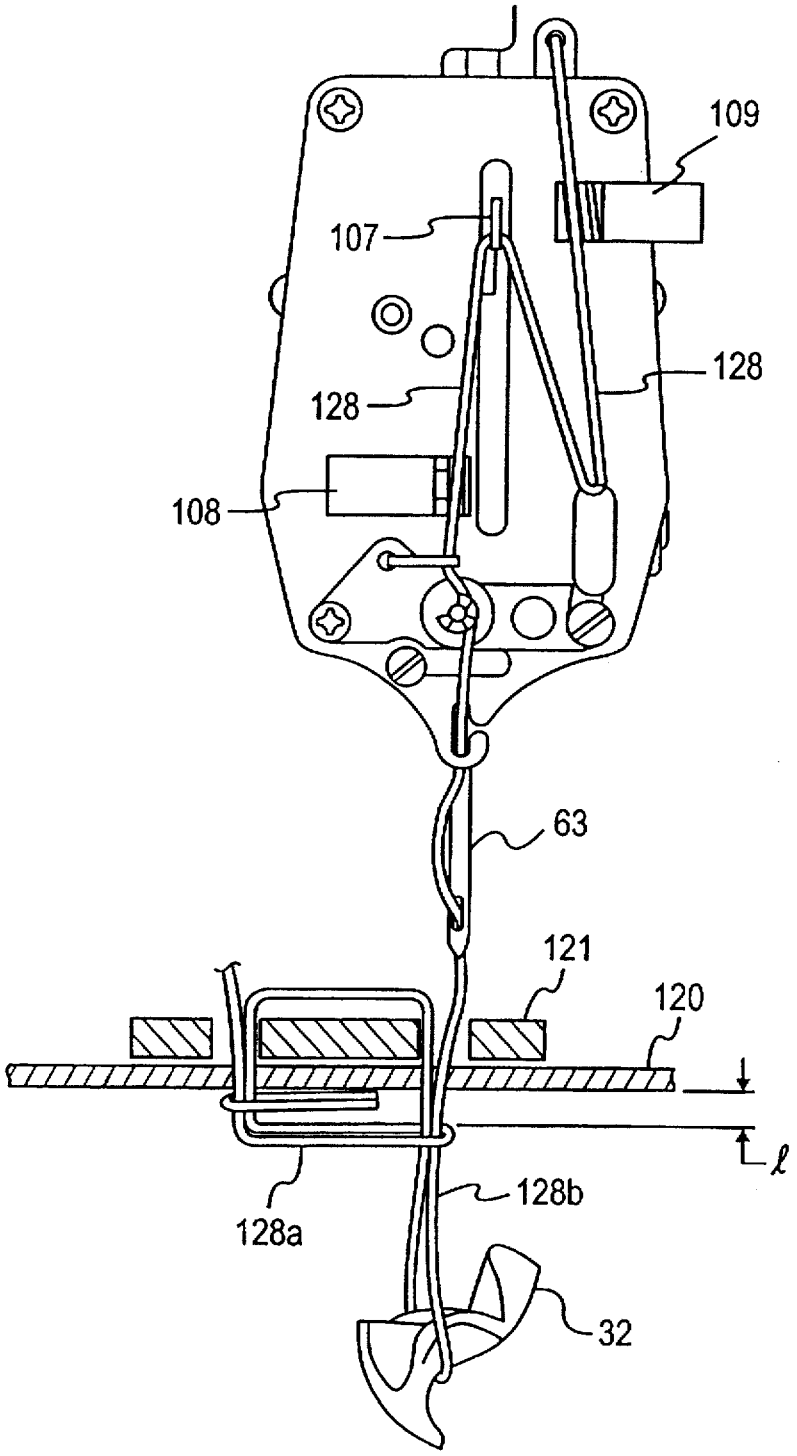
FIG. 21 is a view illustrating a third embodiment of the present invention.

Referring to FIG. 21 which shows an example of the measure for realizing the above-mentioned arrangement, if a gap 1 between the loop 128*a* and the cloth 120 can be ensured by a means for controlling the degree of pull-down of a yarn by means of the balance 107 where a yarn 128 is retained by a yarn retaining device 108 provided between the balance 107 and the needle 63, and a means for paying out the 128 on the needle 63 side with the use of a yarn pay-off device 109 before the yarn is pulled by the balance 107, a loop 128*b* can have a size larger than that formed by a conventional method, and accordingly, a knot similar to that stated in the first or second embodiments as mentioned above can be obtained. The chain-stitch sewing machine in the third embodiment of the present invention has a construction similar to that of the first or second embodiment, except that the yarn retaining device and the yarn pay-off device are provided, instead of the yarn tying device and the above-mentioned link mechanism for driving the yarn tying plate 75, and accordingly, detailed explanation thereof is omitted.

Explanation will be made of a fourth embodiment of the present invention.

Figure 22:
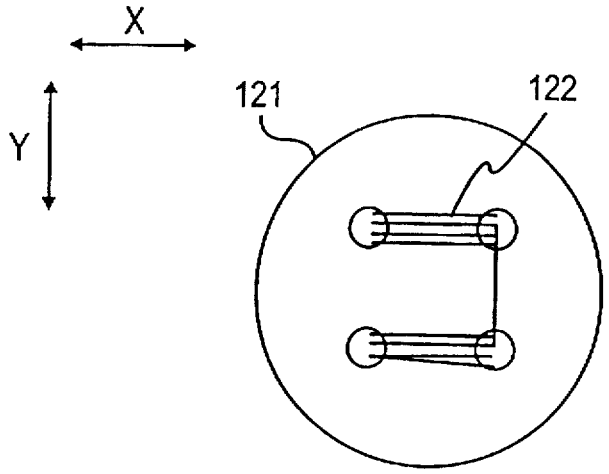
FIG. 22 is a plan view illustrating a sewing pattern for explaining a fourth embodiment of the present invention.

FIG. 22 is a plan view showing a button 121 sewn according to the first embodiment of the present invention. In this example, the button clamp 50 is moved in a direction X as shown in FIG. 22 by the longitudinal cam 43, and is moved in a direction of Y as shown in FIG. 22 by the lateral feed cam 44 (refer to FIGS. 1, and 2), the button 121 is moved in the X-Y directions while the stitches are formed, that is, stitches in a sewing pattern as shown in FIG. 22 are formed.

Figure 23:
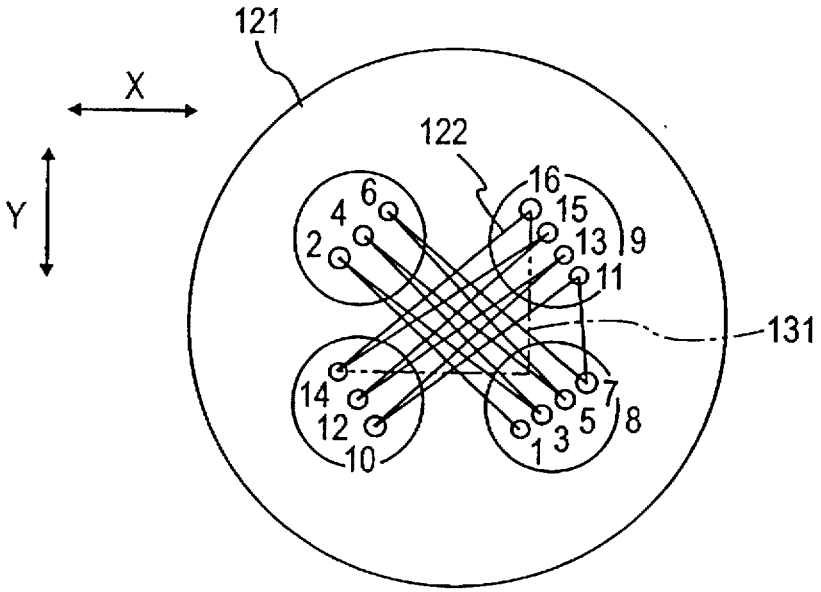
FIG. 23 is a plan view showing a sewing pattern (pattern X) for explaining the fourth embodiment of the present invention.
Figure 24:
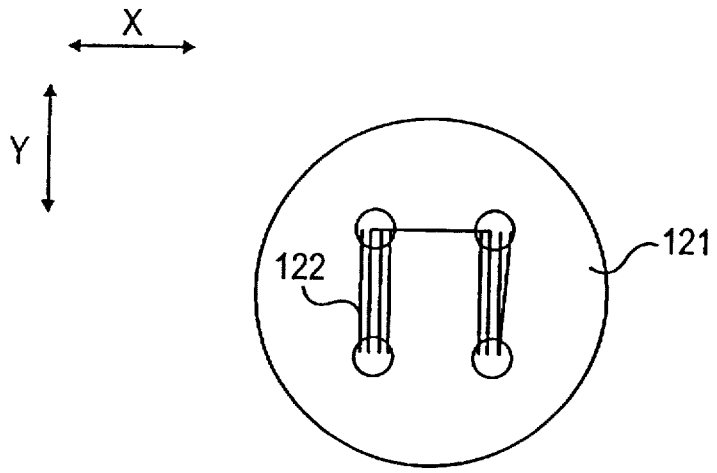
FIG. 24 is a plan view showing a sewing pattern (pattern H) for explaining the fourth embodiment of the present invention.

FIG. 23 shows a case of stitches formed in an X-like sewing pattern (which will be denoted simply "pattern X") for the button having four button holes, similar to the case shown in FIG. 22. It is noted that reference numerals 1, 2, 3 . . . 16 in the FIG. 23, which are denoted as No. 1, No. 2 . . . No. 16 below, are the order numbers of needle positions. In the sewing machine for sewing a button, it is well-known that the sewing pattern can be changed by changing the shape of the groove 43*a* of the longitudinal feed cam 43 and/or the shape of the groove 44*a* of the lateral feed cam 44. Further, in the sewing pattern shown in FIG. 22, the movement of the button to a needle position one stitch ahead of the final stitch after the formation of a stitch two stitches ahead of the final stitch, is made only in the direction X.

However, in the case of sewing the X pattern, if the button is moved to a needle position (No. 15) one stitch ahead of the final stitch, after the formation of a stitch (No. 14) two stitches ahead of the final stitch, a movement in the direction Y is combined with a movement in the direction X, and accordingly, oblique movement is made. With such a movement in the direction Y, the first loop 122*a* formed at the needle position (No. 14) two stitches ahead of the final position is drawn in the direction Y. Thus, the yarn hooking device 78 (yarn catching means) cannot catch only a single yarn (arc) forming a first loop 122*a* (refer to FIG. 5). That is, no yarns (arcs) forming the first loop can be caught, or two yarns on both sides (arcs) forming the first loop are caught.

Accordingly, in the fourth embodiment, if the button is moved to the needle position (No. 15) one stitch ahead of the final stitch after the formation of the stitch (No. 14) two stitches ahead of the final stitch, without oblique movement where a movement in the direction X and a movement in the direction Y are combined, the button is moved at first in the direction X, and thereafter it is moved in the direction Y. Such a movement can be realized by changing the shape of the groove 43*a* of the longitudinal feed cam 43 from that of the conventional cam used in the direction X. The other arrangement is similar to that in the first, second or third embodiment of the present invention, and accordingly, detailed explanation thereto is omitted.

With this arrangement, in the movement of the button toward the needle position (No. 15) one stitch ahead of the final stitch after the formation of the stitch (No. 14) two stitches ahead of the final stitch, the yarn hooking device 78 catches only one yarn (arc) forming the first loop 12 until the movement of the button 121 in the direction X is completed.

That is, the yarn hooking device 78 can surely catch only one yarn (arc) forming the first loop 122*a*, and thereafter, the yarn does not come off even though the button 121 is moved in the direction Y. The two-dot chain line 131 in FIG. 23 is a locus of the tip of the needle on the button 121, being caused by the movement of the button 121.

Figure 25:
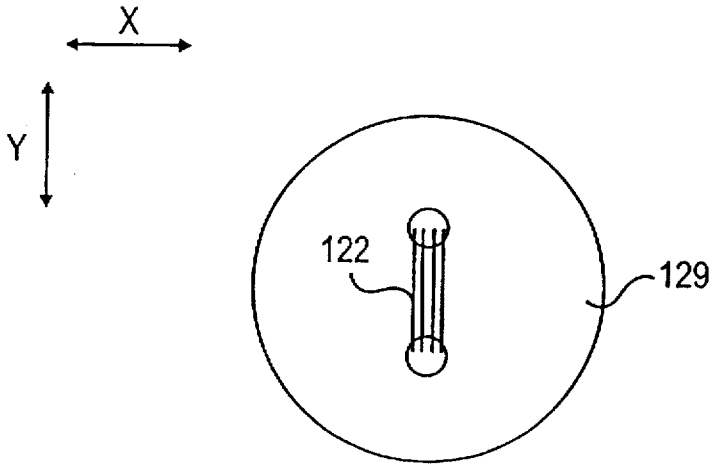
FIG. 25 is a plan view showing a sewing pattern (pattern I) for explaining the fourth embodiment of the present invention.

In the case of the sewing pattern (pattern H) as shown in FIG. 12, for the button 121, or the sewing pattern (patten I) as shown in FIG. 25, for a button 29 having two button holes, after the formation of the stitch two stitches ahead of the final stitch, the movement of the button to the needle position one stitch ahead of the final stitch is made only in the direction Y. Even in such a case, the yarn hooking device 78 can catch the first loop before the movement of the button in the direction Y by changing the shape of the groove 43*a* of the longitudinal feed cam 43 or the shape of the groove 44*a* of the lateral feed cam 44.

It goes without saying that the first to fourth embodiments should not be those which limit the technical scope of the present invention as mentioned below.

Although examples of the sewing machines for sewing a button in single chain-stitching, have explained in the above-mentioned embodiment, a sewing machine for forming single chain-stitches such as a straight sewing or mending of button holes, can form similar stitches if the motion given by the yarn tying plate 75.

Although the yarn pay-off motion of the yarn tying plate 75 is as shown in FIG. 19, in the first, second and fourth embodiments of the present invention, an arrow 123α, 123β or 123γ of the yarn 123 may be formed by paying off the yarn at any position. Further, the direction of pay-off may be any direction, not just the direction of the arrow R, if the yarn 123 can be caught by the yarn hooking device 78 of the yarn tying plate 75. Of course, it can be not only rotated but moved straight as well.

Although the motion of the yarn tying plate 75 is obtained by the yarn tying cam 70 provided on the can shaft 41, and is transmitted by the predetermined link mechanism in the first, second and fourth embodiments of the present invention, it can be transmitted by means of a wire. Further, the yarn tying plate may be actuated by a predetermined actuator with a timing given by an output electrical signal, instead of the motion of the yam tying cam 70.

Although the yarn is cut in cooperation between the movable knife 93 and the stationary knife 94 in the first to fourth embodiments of the present invention, the yarn may be broken off from a knot node by pulling the yam in the completed part of the sewing.

While the invention has been described in detail and with reference to specific embodiments thereof, it will be apparent to one skilled in the art that various changes and modifications can be made therein without departing from the spirit and scope thereof. Thus, it is intended that the present invention cover the modifications and variations of this invention provided they come within the scope of the appended claims and their equivalents.

What is claimed is:

1. A chain stitch sewing machine for forming chain stitches comprising:

a vertically movable needle;

a rotary looper making a loop of a yarn fed from the needle;

a yarn draw-up for drawing the loop in a direction opposing the needle's downward motion; and a hooking device capable of catching and releasing a first portion of a first yarn loop, for holding the first portion at a predetermined position;

wherein the hooking device catches the first portion of the first yarn loop which is being drawn toward an article to be sewn, and releases the first portion of the first yarn loop before a second yarn loop made by the rotary looper next to the first yarn loop is drawn toward the article to be sewn during formation of a final stitch such that the first yarn loop is larger than the second yarn loop at drawing the second yarn loop toward the article to be sewn.

2. A chain stitch sewing machine for forming chain stitches in cooperation between a vertically movable needle and a rotary looper, the machine comprising:

a hooking device capable of catching and releasing a first portion of a first yarn loop, for holding the first portion at a predetermined position, wherein the hooking device catches the first portion of the first yarn loop which is drawn toward an article to be sewn, and releases the first portion of the first yarn loop before a second yarn loop next to the first yarn loop is drawn toward the article to be sewn during formation of a final stitch; and a nipper arranged nearer to a needle yarn supply side than to the vertically movable needle, for locking the needle yarn, and yarn pay-off means for paying off the yarn between the needle and the nipper.

3. A chain stitch sewing machine for forming chain stitches in cooperation between a vertically movable needle and a rotary looper the machine comprising:

a hooking device capable of catching and releasing a first portion of a first yarn loop, for holding the first portion at a predetermined position, wherein the hooking device catches the first portion of the first yarn loop which is drawn toward an article to be sewn, and releases the first portion of the first yarn loop before a second yarn loop next to the first yarn loop is drawn toward the article to be sewn during formation of a final stitch; and needle position adjusting means for obtaining a predetermined small space at each of needle positions from a needle position at which the first yarn loop is formed, to a needle position of the final stitch.

* * * * *

UNITED STATES PATENT AND TRADEMARK OFFICE

CERTIFICATE OF CORRECTION

PATENT NO. : 5,887,533

DATED : March 30, 1999

INVENTOR(S) : Tsukioka et al.

It is certified that error appears in the above-identified patent and that said Letters Patent is hereby corrected as shown below:

Column 14, line 16, change "looper the" to --looper, the--.

Signed and Sealed this

First Day of February, 2000

*Attest:*

Q. TODD DICKINSON

*Attesting Officer*

*Acting Commissioner of Patents and Trademarks*